United States Patent [19]

Maciejewski

[11] 4,012,743

[45] Mar. 15, 1977

[54] ANTENNA SYSTEM INCLUDING A PARABOLOIDAL REFLECTOR AND AN EXCITER

[75] Inventor: Kurt Maciejewski, Ludwigsburg, Germany

[73] Assignee: Licentia Patent-Verwaltungs-G.m.b.H., Frankfurt am Main, Germany

[22] Filed: Feb. 6, 1976

[21] Appl. No.: 655,983

[30] Foreign Application Priority Data

Feb. 8, 1975 Germany ..... 2505375

[52] U.S. Cl. ..... 343/781 R; 343/784; 343/786; 343/840

[51] Int. Cl.[2] ..... H01Q 15/16

[58] Field of Search ..... 343/781, 784, 786, 840

[56] References Cited

UNITED STATES PATENTS 3,949,404 4/1976 Green ..... 343/781

*Primary Examiner*—Eli Lieberman
*Attorney, Agent, or Firm*—Spencer & Kaye

[57] ABSTRACT

An improved antenna system of the type including a parabolic antenna with offset exciting in which only the upper portion of the parabola is used, an approximately horizontal bottom plate, and an exciter which is disposed above the bottom plate. The exciter has a tilt angle of about 50°. The paraboloidal reflector is covered by a dielectric cover plate which is inclined to the vertical so that the cover plate and parabola contact in a single plane, and a portion of both sides of the width of the parabola is removed, and side sheets are provided to connect the paraboloidal bowl and the cover plate. The exciter is a conical multimode exciter with an aperture angle of about 100° and is provided with at least one and preferably a plurality of concentrically arranged slits on the conical surface of the exciter facing the paraboloidal reflector with the depth of the slits decreasing in a direction toward the edge of the cone adjacent the reflector. The width of the slits is between $\lambda/10$ and $\lambda/20$, the spacing between adjacent ones of the slits is between $\lambda/8$ and $\lambda/4$, the smaller diameter of the conical exciter is about $\lambda/1.2$, and the larger diameter of the conical exciter is about $3\lambda$, where $\lambda$ is the wavelength of the center frequency of the operating frequency band of the antenna system.

5 Claims, 2 Drawing Figures

ANTENNA SYSTEM INCLUDING A PARABOLOIDAL REFLECTOR AND AN EXCITER

BACKGROUND OF THE INVENTION

The present invention relates to an antenna system comprising a paraboloidal mirror or reflector in which only the upper portion of the parabola is used and in which a multiple mode exciter is disposed above an approximately horizontal bottom plate. These antennas are known as Horn parabolic antennas.

For the determination of star points in radio networks it is possible to operate one operating frequency in a broadband system several times at the same location if a certain decoupling is provided between the individual beam directions. The requirement for decoupling between two beam directions operating at the same frequency, for example, in the 6GHz radio ranges, is 65 dB beginning with an aperture angle of ±35°.

SUMMARY OF THE INVENTION

It is the object of the present invention to provide an antenna system which offers high angular attenuation, optimum space utilization, low reflection and permits simultaneous use of a plurality of radio frequency bands up to one octave.

The above object is accomplished, according to the present invention, in that an antenna system comprising a parabolic antenna with offset exciting of the type including a paraboloidal reflector in which only the upper portion of the parabola is used, an approximately horizontal bottom plate, and an exciter which is disposed above the mentioned bottom plate, is provided with the following features: the exciter has a tilt angle of about 50°, the paraboloidal reflector is covered by a dielectric cover plate which is inclined against the vertical so that the cover plate and parabola contact in one plane; a portion of both sides of the width of the parabola is removed and side sheets are provided to connect the parabolic bowl and the cover plate; the exciter is designed as a conical multiple mode exciter with an aperture angle of about 100° and is provided with at least and preferably a plurality of one concentrically arranged slits on the conical surface of the exciter facing the reflector, the slits decrease in depth in the direction toward the edge of the cone adjacent the reflector, the width of the slits is between λ/10 and λ/20, the spacing between adjacent slits is between λ/8 and λ/4, the smaller diameter of the exciter is about λ/1.2, while the larger diameter of the exciter is about 3λ where λ is the wavelength of the center frequency of the operating frequency band of the antenna system.

DETAILED DESCRIPTION OF THE PREFERRED EMBODIMENTS

Figure 1:
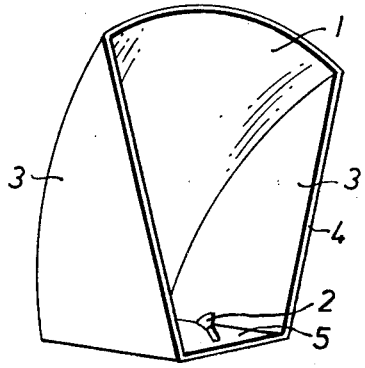
FIG. 1 is a schematic illustration of the antenna system according to the invention.

Referring now to FIG. 1 there is shown a schematic representation of an antenna system according to the invention in which the parabolic antenna with offset exciting is formed by the upper portion 1 of a parabola which is mounted on a substantially horizontal base or bottom plate 5 and which has a portion of both sides thereof removed or cut off and provided with forwardly extending side sheets 3. The paraboloidal reflector is provided with a dielectric cover plate 4 which is inclined with respect to the vertical so that it contacts the portion 1 in only a single plane and is further connected thereto via the side sheets 3. Disposed above the substantially horizontal bottom plate 5 is the exciter 2 which has a tilt angle of approximately 50°.

Figure 2:
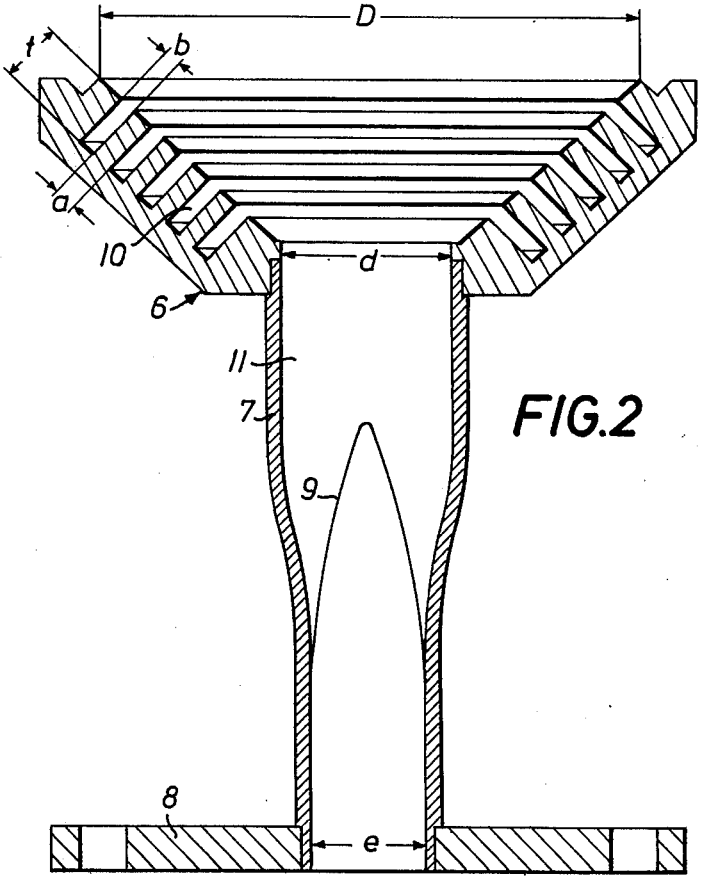
FIG. 2 is an enlarged cross sectional view of the exciter and feed line for the antenna system according to the invention.

The exciter 2 for illuminating the antenna system thus far described is specially designed and dimensioned and is shown in longitudinal section in FIG. 2. The exciter 2 is a defined multimode exciter with an aperture angle of about 100°. The exciter 2 includes a frusto conical exciter or horn 6 which in the illustrated embodiment is connected at its smaller end, via a broadband circular to square waveguide transition 7, 9, with a square feeder waveguide (not shown) by the flange 8. The inner surface of the frusto conical exciter 6, which conically widens in the beam emission direction, is provided with at least four concentrically arranged slits 10, five such slits 10 being shown in the illustrated embodiment. The slit depth t of these slits 10 decreases in a direction toward the edge of the conical frustum 6 having the larger diameter D and which faces the reflector portion 1. The five slits 10 of the illustrated embodiment are each spaced from one another at a spacing a and have a width *b*. The width *b* of the slits 10 which lies between λ/10 and λ/20 is preferably selected to be identical for all slits and the spacing a of the individual slits lies between λ/8 and λ/4, where λ is the middle wavelength of the operating frequency band of the antenna system. The smaller diameter *d* of the frusto conical exciter 6 is particularly important in the selection of the dimensions. This smaller diameter *d* should be as small as possible, but not less than the limit wavelength of the $H_{E11}$ mode. This can generally be achieved if the smaller diameter *d* is selected to be about λ/1.2. The larger diameter D of the frusto conical exciter 6 will be selected to be about three wavelengths, i.e., 3λ. The slit depth *t* which decreases towards the edge of the frusto conical exciter 6 with the larger diameter may be dimensioned, in a preferred embodiment, so that it decreases greater than linearly, for example, according to a quadratic function.

The transition from the circular end of the conical exciter 6 with the diameter *d* to the square feeder waveguide which is not shown in the drawing, is effected, as indicated above, by a broadband waveguide transition 7 whose tapered transition zone is marked 9. By suitably selecting the length of the circular waveguide section 11 following the tapered zone 9 and toward the entrance of the conical exciter 6 it is possible to provide compensation for the matching error caused by the aperture as well as the matching error resulting from the tapered transition zone 9.

An antenna system constructed according to the present invention produced, in the 6.8. GHz radio range, an angular attenuation of 65 dB with parallel polarization beginning at about ± 30° and with cross polarization beginning at about ± 15°. The reflection factor was $r = 1\%$ and the area utilization $q = 55\%$. The width b of the slits 10 was 0.1λ and the slit depth *t* was 0.33λ. Tapered zone 9 has a length of 1.25λ guide.

The waveguide transition piece 9 is constructed according the following formula $$\lambda_{TR} + e\,[1.54d/e + 0.78\,(d/e)^2 - 0.61\,(d/e)^3]$$

where $\lambda_{Tr}$ is the cut off wavelength of the trasition $d$ is the diameter of circulator guide 7

$e$ is the length of a side of the square guide connected to flange 8.

The frequency range of operation of an antenna according to the present invention is about one octave.

The system can be used over a very broad band, simultaneous operation being possible with a plurality of frequency bands which differ by up to an octave. Additionally, the antenna characteristic exhibits a great axial field symmetry.

It will be understood that the above description of the present invention is susceptible to various modifications, changes and adaptations, and the same are intended to be comprehended within the meaning and range of equivalents of the appended claims.

What is claimed is:

1. In an antenna system comprising a paraboloidal antenna with offset exciting, an approximately horizontal bottom plate, and an exciter which is disposed above the mentioned bottom plate, the improvement wherein: said exciter has a tilt angle of about 50°, said paraboloidal reflector is covered by a dielectric cover plate which is inclined to the vertical so said cover plate and parabola contact in a single plane; a portion of both sides of the width of the parabola is removed, and side sheets are provided to connect the paraboloidal bowl and the cover plate; said exciter is a conical multimode exciter with an aperture angle of about 100° and is provided with at least one concentrically arranged slit on the conical surface of the exciter facing said paraboloidal reflector, the width of said slit is between $\lambda/10$ and $\lambda/20$, the smaller diameter of said conical exciter is about $\lambda/1.2$, and the larger diameter of said conical exciter is about $3\lambda$ where $\lambda$ is the wavelength of the mid-frequency of the operating frequency band of the antenna system.

2. Antenna system as defined in claim 1 further comprising a square feeder waveguide, a broadband and square waveguide to circular waveguide transition piece connected between said square waveguide and the end of said exciter with the smaller diameter.

3. Antenna system as defined in claim 1 wherein: said exciter is provided with a plurality of said concentrically arranged slits; the depth of said slits decreases in a direction toward the edge of the cone adjacent said reflector; and the spacing between adjacent said slits is between $\lambda/8$ and $\lambda/4$.

4. An antenna system as defined in claim 3 wherein the slit depth decreases more than linearly.

5. An atenna system as defined in claim 3 wherein there are at least four of said concentrically arranged slits.

* * * * *